US006718873B1

(12) United States Patent
Sambri et al.

(10) Patent No.: US 6,718,873 B1
(45) Date of Patent: Apr. 13, 2004

(54) PROOF PRESS FOR MOUNTING FLEXOGRAPHIC PRINTING PLATES

(75) Inventors: Stefano Sambri, San Lazzaro di Savena (IT); Alberto Zanoli, Sala Bolognese (IL)

(73) Assignee: Bieffebi S.p.A., Quarto Inferiore (IT)

( * ) Notice: Subject to any disclaimer, the term of this patent is extended or adjusted under 35 U.S.C. 154(b) by 0 days.

(21) Appl. No.: 10/387,403

(22) Filed: Mar. 14, 2003

(51) Int. Cl.[7] ..... B41F 13/10

(52) U.S. Cl. ..... 101/375; 101/377; 101/378; 101/477; 101/212; 101/216; 101/415.1; 101/404; 101/382.1

(58) Field of Search ..... 101/375, 377, 101/378, 977, 212, 216, 415.1, 382.1, 404

(56) References Cited

U.S. PATENT DOCUMENTS

| | | | | | |
|---|---|---|---|---|---|
| 1,096,112 | A | * | 5/1914 | Kush | 156/94 |
| 4,653,369 | A | * | 3/1987 | Dunsirn | 83/411.7 |
| 5,488,781 | A | * | 2/1996 | Van Der Horst | 33/617 |
| 5,666,881 | A | * | 9/1997 | Zanoli | 101/477 |
| 6,308,629 | B1 | * | 10/2001 | Smith | 101/477 |

FOREIGN PATENT DOCUMENTS

| | | | | |
|---|---|---|---|---|
| DE | 101 12 417 | | 7/2002 | |
| EP | 0 313 510 | | 4/1989 | |
| EP | 0 728 580 | | 8/1996 | |
| EP | 728580 | A1 * | 8/1996 | ..... B41F/27/00 |
| EP | 1 060 884 | | 12/2000 | |
| EP | 1060884 | A1 * | 12/2000 | ..... B41F/27/00 |
| GB | 803 377 | | 10/1958 | |

* cited by examiner

*Primary Examiner*—Charles H. Nolan, Jr.
*Assistant Examiner*—Andrea H. Evans
(74) *Attorney, Agent, or Firm*—Guido Modiano; Albert Josif; Daniel O'Byrne

(57) ABSTRACT

A proof press for the mounting of flexographic printing plates, comprising a printing cylinder, which is covered by a blanket for the mounting of at least one printing plate with double adhesive tape interposed, the printing cylinder being movable at right angles to its own axis in order to be placed in contact, along a generatrix, with a respective impression roller for performing proof prints, an optical system for collimating points of the impression roller with respective points of the printing plate by direct viewing, and a compression device for producing the forced adhesion of the printing plate to the double-adhesive tape and to the blanket.

8 Claims, 3 Drawing Sheets

PROOF PRESS FOR MOUNTING FLEXOGRAPHIC PRINTING PLATES

BACKGROUND OF THE INVENTION

The present invention relates to a proof press for mounting flexographic printing plates.

As is known, an apparatus for the flexographic printing of corrugated cardboard is provided with one or more flexographic printing plates, which are fixed, by way of double adhesive tape, to corresponding mounting and supporting blankets. Generally, these printing plates are mounted on a curved surface, i.e., on a blanket cylinder of a suitable machine.

Printing plates with gradually increased dimensions were used, which gave rise to unwelcome phenomenon such as separation of the printing plate from the blanket, with infiltration of air and formation of pockets, particularly when the blanket with the corresponding printing plate is spread flat. This is due substantially to the generation of two opposite actions: a traction on the blanket and a compression on the thin polyester film provided on the lower face of the printing plate. These opposite actions can reach intensities that overcome the adhesive action of the tape, causing unacceptable bulges in one or more points.

However, it has been noted in this regard that the separation of the printing plate from the blanket is less evident if blanket cylinders are used, having a large diameter and in which therefore the ratio between the length of the printing plate and the length of the circumference of said cylinder is low.

In order to obviate the problem of the separation of the printing plate from the blanket, machines for mounting the printing plate on the blankets in a flat configuration have been devised: in this case, no significant separations are observed when the blanket and the printing plate are laid flat, but when they are wound in a curved configuration onto a cylinder to perform a proof print, one or more bulges of the blanket with respect to the printing plate are observed. A compression on the blanket and a traction on the printing plate are generated and can overcome the adhesion forces produced by the presence of the tape.

Although in this last mounting situation the phenomenon is in practice less conspicuous than observed in conventional mounting on a curved surface, it is known that machines for mounting printing plates in a flat configuration are unable to perform proof prints, which can be performed exclusively on proof presses provided with a blanket cylinder.

SUMMARY OF THE INVENTION

The aim of the present invention is to provide a proof press that is suitable for the mounting of a flexographic printing plate in a curved configuration without the drawbacks noted above, i.e., that is capable of performing proof prints without causing separations of the printing plate from the blanket.

Within this aim, an object of the present invention is to provide a structure that is simple, relatively easy to provide in practice, safe in use, effective in operation, and relatively low in cost.

This aim and this object are achieved by the present proof press for the mounting of flexographic printing plates, comprising a printing cylinder, which is covered by a blanket for mounting at least one of said printing plates by means of double adhesive tape and is movable at right angles to its own axis in order to be placed in contact, along a generatrix, with a respective impression roller for performing proof prints, and optical means for collimating points of said impression roller with respective points of said printing plate viewed directly, characterized in that it comprises a compression device that is adapted to produce the forced adhesion of said printing plate to said double-adhesive tape and to said blanket, so as to provide uniform fixing over the entire contact surface, avoiding the onset of separation or bulging.

BRIEF DESCRIPTION OF THE DRAWINGS

Further features and advantages of the invention will become better apparent from the detailed description of a preferred but not exclusive embodiment of a proof press for mounting flexographic printing plates according to the invention, illustrated only by way of non-limitative example in the accompanying drawings, wherein.

DESCRIPTION OF THE PREFERRED EMBODIMENTS

Figures 4, 5:
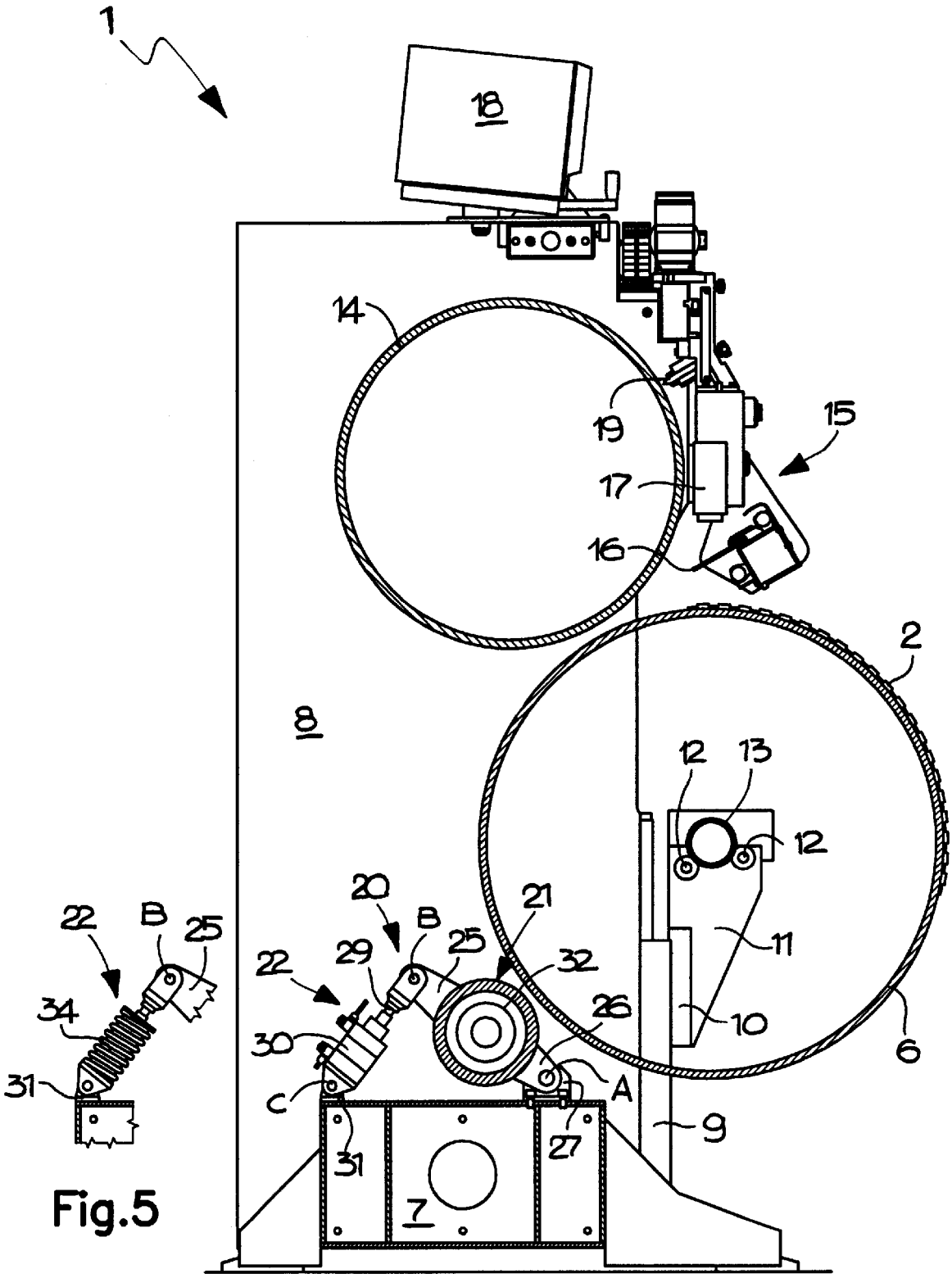
FIG. 4 is a partially sectional side elevation view of the proof press according to the invention.
FIG. 5 is a partially sectional side elevation view of a detail of another embodiment of the device for compressing the printing plate against the blanket.

With reference to FIG. 4, the reference numeral 1 generally designates a proof press for mounting flexographic printing plates according to the invention.

Figure 1:
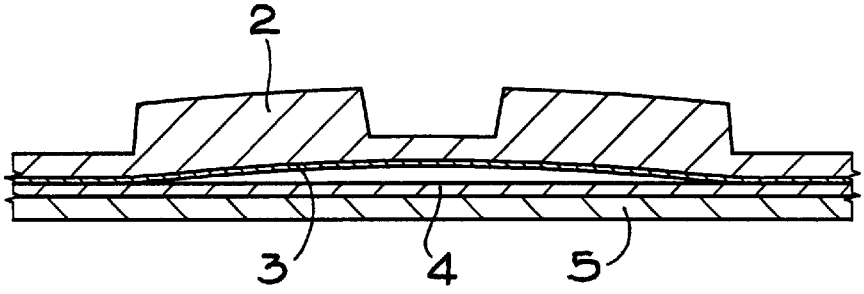
FIG. 1 is a transverse sectional view of a detail of the separation of the flexographic printing plate from the double adhesive tape for fixing to the mounting blanket, if the printing plate is fixed to the blanket on a cylindrical surface.

For better comprehension, reference should be made first to FIG. 1, in which a printing plate 2 (made of a material such as photopolymers), lined on its lower face with a polyester film 3 for dimensional stabilization, is fixed, by way of double adhesive tape 4, to a blanket 5 for mounting on a printing cylinder 6. As described earlier, mounting the printing plate 2 onto the blanket 5 along a curved surface and then laying said printing plate and said blanket onto a flat surface, the polyester film 3 of the printing plate 2 is seen to separate and bulge with respect to the double adhesive tape 4.

Figure 2:
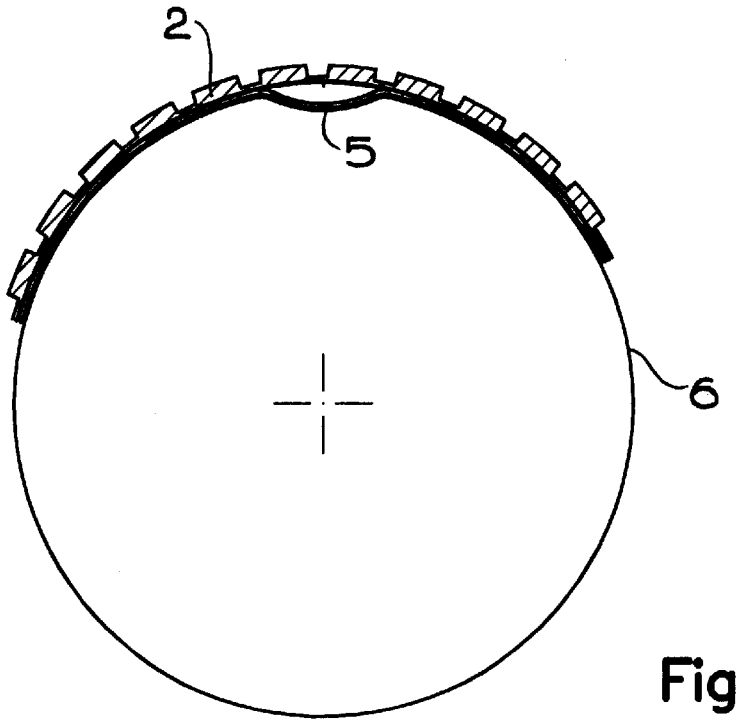
FIG. 2 is a partially sectional side elevation view of a printing roller, showing the separation of the mounting blanket of the flexographic printing plate, which is fixed to said blanket on a flat surface.

FIG. 2 clearly illustrates the separation and bulging of the blanket 5 with respect to the printing plate 2, previously assembled on a flat surface, after fixing to a printing cylinder 6.

Figure 3:
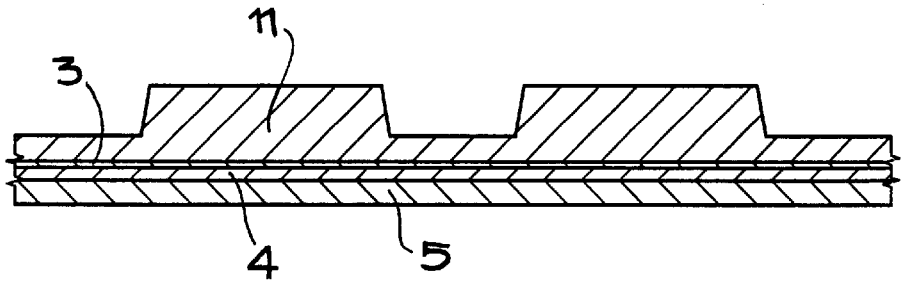
FIG. 3 is a transverse sectional view of a detail of the correct configuration for mounting the printing plate on the blanket.

FIG. 3 instead illustrates the correct configuration for mounting the printing plate 2 on the blanket 5, i.e., without separations or bulges.

As shown in FIG. 4, the machine comprises a footing 7 that rises vertically on opposite sides with two parallel side walls 8. The side walls 8 are provided at the front with guides 9 for the vertical sliding of respective sliders 10, which are associated with translational motion means, which are not shown in the figures because they are conventional; each slider 10 forms an upper extension 11 for accommodating, at the top, rolling bearings 12 for rotatably supporting a printing cylinder 6, which has a horizontal axis and on which a blanket 5 with the corresponding printing plate 2 is mounted.

Preferably, the printing cylinder 6 has respective pivot-like ends 13, each of which rests on respective pairs of rolling bearings 12.

The footing 7 supports rotatably, in its upper portion, an impression roller 14, whose axis is parallel to the axis of the printing cylinder 6; the impression roller 14 is designed to make contact, along a generatrix, with the printing cylinder 6 in order to perform proof prints.

The machine has, at the top, optical means 15, known per se are disclosed in EP 0 728 580 by the same Applicant, which are adapted to produce the collimation of specific points of the impression roller 14 with respective points of the printing plate 2 that are viewed directly.

The optical means 15 comprise a semitransparent mirror 16 and a television camera 17, which are located at the lateral surface of the impression roller 14 and are functionally connected to a monitor 18 that is supported at the top of the footing 17 of the machine. The impression roller 14 is designed to be covered with a suitable sheet of paper provided by suitable tracings of lines and/or dots, provided by means of a writing device 19; during the fine-tuning of the machine, said dots are made to collimate with respective dots of the printing plate 2 that are viewed directly by virtue of the optical means 15.

The machine comprises, according to the invention, a device 20 for compressing the printing plate 2 against the blanket 5, which is fixed onto the printing cylinder 6, while said printing cylinder is shifted into a suitable downward position. The printing cylinder 6 can therefore perform a translational motion along the guides 9 between a lower position for compressing the printing plate 2 against the double adhesive tape 4 and against the blanket 5, an intermediate position for mounting the printing plate 2, and a raised position in which it is in contact with the impression roller 14. The compression device 20 is suitable to produce the forced adhesion of the printing plate 2 to the double-adhesive tape 4 and accordingly to the blanket 5: this facilitates the elimination of air pockets, which cause bulges and are present between the polyester film 3 and the double adhesive tape 4, accordingly achieving uniform fixing over the entire contact surface.

Figure 6:
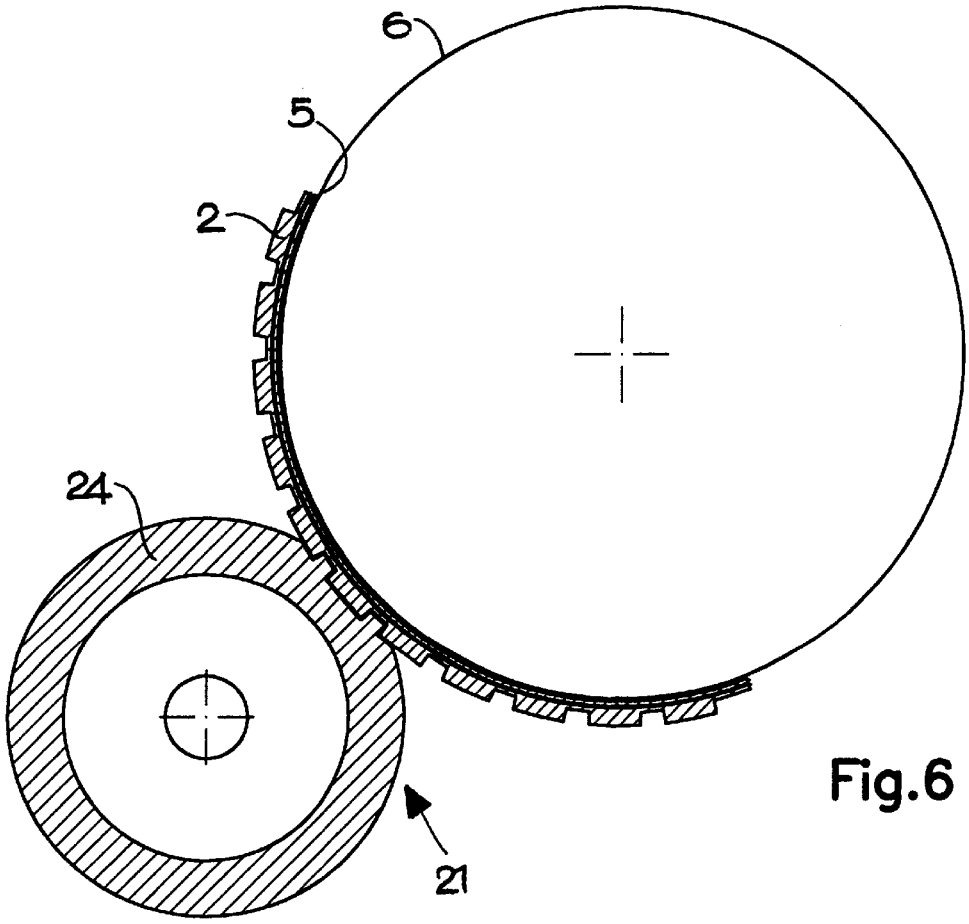
FIG. 6 is a schematic partially sectional side elevation view of a detail of the machine during the mounting of the flexographic printing plate on the blanket.

The compression device 20 comprises a compaction roller 21, whose axis is parallel to the axis of the printing cylinder 6; said compaction roller is associated with actuation means 22 so that it can move from an inactive configuration to an active configuration in which it is in contact, along a generatrix, with the printing cylinder 6, in order to produce the uniform adhesion, in mutual rolling, of the printing plate 2 on the double adhesive tape 4 (FIG. 6).

The compaction roller 21 is constituted by an elongated tubular core 23, along which a sleeve 24 is keyed; said sleeve is made of substantially flexible material, preferably soft rubber or the like.

The actuation means 22 comprise at least one pair of cranks 25, each of which has a first end 26 that is pivoted, about a first articulation axis A, to a first bracket 27 that is fixed to the footing 7, and a second end 28 that is pivoted, about a second articulation axis B, to the stem 29 of a linear actuator 30, preferably of the pneumatic type; in turn, said actuator has, at its other end, its cylinder pivoted to a second bracket 31 that is rigidly coupled to the footing 7, about a third articulation axis C. The cranks 25 are affected, substantially in their central portion, by respective seats 32 for bearings 33 for rotationally supporting the tubular core 23 of the compaction cylinder 21. Each crank 25 and the respective linear actuator 30 are arranged so that the respective longitudinal axes form an angle of less than 180° between them. Each one of the cranks 25 can rotate about the first articulation axis A by actuation of the respective actuator 30 so as to move the compaction roller 21 from the inactive configuration to the active configuration, in which it is in forced contact with the printing cylinder 6.

Figure 7:
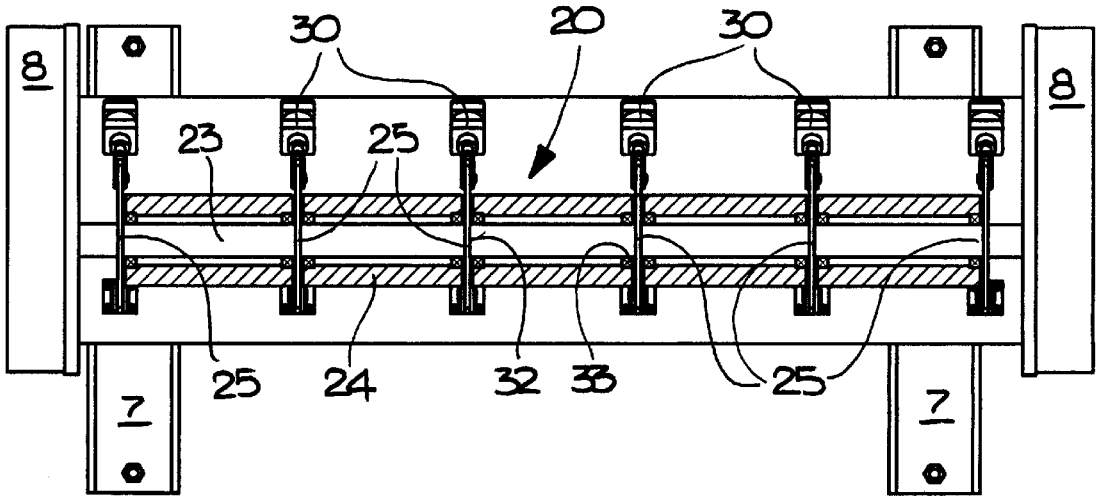
FIG. 7 is a partially sectional top view of a detail of the proof press according to the invention.

Advantageously, the compaction roller 21 is supported, in the specific case (as shown in FIG. 9), by a plurality of cranks 25, which are provided at the footing 7 substantially axially equidistant and are associated with respective pneumatic linear actuators 30, which operate conveniently in step with each other, as clearly shown in FIG. 7. In this manner, the compression thrust on the printing cylinder 6 and the load on the footing 7 are distributed uniformly. The sleeve 24 is divided for this purpose into a plurality of portions of equal length, which are keyed on the tubular core 23 between each crank 25 and the directly adjacent crank.

In practical operation, after fixing the flexographic printing plate 2 to the printing cylinder 8 in the intermediate position, said printing cylinder is moved into the lower position, and then the pneumatic linear actuators 30 are actuated simultaneously, in order to move the compaction roller 21 from the inactive configuration to the active configuration, in which it is in contact with the printing cylinder 8, by rotating the cranks 25 about the first articulation axis A. Then the rotation of the printing cylinder 8 is started, so that the substantially radial thrust applied by the compaction roller 21 allows complete and uniform adhesion of the printing plate 11 to the blanket 10, expelling any interstitial air pockets: in this manner, the printing plate 11 is fixed to the blanket 10 in an optimum manner, without separation or bulging.

It has thus been shown that the invention achieves the intended aim and object.

The invention thus conceived is susceptible of numerous modifications and variations, all of which are within the scope of the appended claims.

In particular, FIG. 5 illustrates an important detail of another embodiment of the machine according to the invention, which provides for means 22 for actuating the compaction roller 21 which are constituted by compression springs 34 that can be adjusted appropriately and can be actuated mechanically instead of the pneumatic linear actuators 30.

All the details may be replaced with other technically equivalent ones.

In practice, the materials used, as well as the shapes and the dimensions, may be any according to requirements without thereby abandoning the scope of the protection of the appended claims.

In the preferred embodiments described by way of examples, individual characteristics, presented in relation to specific examples, may actually be interchanged with other different characteristics that exist in other examples of embodiment.

Moreover, it is noted that anything found to be previously known is understood not to be claimed.

What is claimed is:

1. A proof press for the mounting of flexographic printing plates, comprising: an impression roller; a printing cylinder having an axis thereof and being movable at right angles with respect to said axis thereof in order to be placed in contact, along a generatrix, with the impression roller for performing proof prints which covers said printing cylinder; a blanket for the mounting of at least one of said printing plates thereon with a double adhesive tape interposed; optical means for collimating points of said impression roller with respective points of said printing plate by direct viewing; and a compression device for producing forced adhesion of said printing plate to the double-adhesive tape and to said blanket with uniform fixing over an entire contact surface free from separation and bulging areas, said compression device comprising a compaction roller having an axis thereof parallel to the axis of said printing cylinder, and actuation means for moving said compaction roller from an inactive configuration to an active configuration in which the compaction roller is in forced contact, along a generatrix, with said printing cylinder, so as to cause optimum adhesion of said printing plate to said mounting blanket, said printing cylinder being movable with a translational motion, at right angles to the axis thereof, between a lower position for compressing said printing plate against said blanket by means of said compaction roller in said active configuration in forced contact with said printing cylinder, an intermediate position for the mounting of said printing plate, and a raised position in which the printing cylinder is in contact, along a generatrix, with said impression roller in order to perform proof prints.

2. A proof press for the mounting of flexographic printing plates, comprising: an impression roller; a printing cylinder having an axis thereof and being movable at right angles with respect to said axis thereof in order to be placed in contact, along a generatrix, with the impression roller for performing proof prints which covers said printing cylinder; a blanket for the mounting of at least one of said printing plates thereon with a double adhesive tape interposed; optical means for collimating points of said impression roller with respective points of said printing plate by direct viewing; and a compression device for producing forced adhesion of said printing plate to the double-adhesive tape and to said blanket with uniform fixing over an entire contact surface free from separation and bulging areas, said compression device comprising a compaction roller having an axis thereof parallel to the axis of said printing cylinder, and actuation means for moving said compaction roller from an inactive configuration to an active configuration in which the compaction roller is in forced contact, along a generatrix, with said printing cylinder, so as to cause optimum adhesion of said printing plate to said mounting blanket, the proof press further comprising: a footing, and linear actuators with respective stems, said actuation means comprising at least two cranks which rotationally support, in a respective central portion, said compaction roller, each one of said cranks having a first end that is pivoted to said footing about a first articulation axis and a second end that is pivoted to the stem of a respective one of said linear actuators about a second articulation axis, the respective linear actuators being pivoted, at a further end thereof, to said footing about a third articulation axis, so that a longitudinal axis of said crank and a longitudinal axis of said linear actuator form, therebetween, an angle of less than 180°, said crank being rotating, upon action of said linear actuators, about said first articulation axis, in order to move said compaction roller from said inactive configuration to said active configuration and vice versa.

3. The machine of claim 2, comprising of said cranks, each associated with a respective linear actuator, said cranks being arranged distributed at said footing so as to be axially equidistant from a first end to a second end of said compaction roller.

4. The machine of claim 3, wherein said compaction roller comprises a tubular core and sleeve that covers said core and is made of elastically flexible material.

5. The machine of claim 4, wherein said sleeve is divided into a plurality of segments of a same length, each of which is keyed to said tubular core between contiguous pairs of said cranks.

6. The machine of claim 4, wherein said sleeve is made of an elastic material, which is preferably soft rubber.

7. The machine of claim 3, wherein said linear actuator are pneumatically actuated.

8. The machine of claim 2, wherein said actuation means for actuating said compaction roller are constituted by compression springs, which are adjustable and actuated mechanically.

* * * * *